US008327571B2

(12) United States Patent
Jaquish et al.

(10) Patent No.: US 8,327,571 B2
(45) Date of Patent: Dec. 11, 2012

(54) FIREARM CLEANING TOOL AND METHOD OF USING

(75) Inventors: Daniel B Jaquish, Pahrump, NV (US); Erik F Bauer, Walde, WI (US)

(73) Assignee: Magna-Matic Corporation, Waldo, WI (US)

( * ) Notice: Subject to any disclaimer, the term of this patent is extended or adjusted under 35 U.S.C. 154(b) by 0 days.

(21) Appl. No.: 13/474,882

(22) Filed: May 18, 2012

(65) Prior Publication Data

US 2012/0240445 A1 Sep. 27, 2012

Related U.S. Application Data

(62) Division of application No. 12/655,939, filed on Jan. 11, 2010.

(60) Provisional application No. 61/204,885, filed on Jan. 12, 2009.

(51) Int. Cl.
*F41A 29/02* (2006.01)

(52) U.S. Cl. ..... 42/95

(58) Field of Classification Search ..... 42/95, 90, 42/107, 108; 86/19.7, 28
See application file for complete search history.

(56) References Cited

U.S. PATENT DOCUMENTS

| | | | |
|---|---|---|---|
| 2,562,136 | A | 7/1951 | Sullins |
| 2,746,219 | A | 5/1956 | Talbot |
| 3,765,045 | A | 10/1973 | Schneider et al. |
| 3,952,923 | A | 4/1976 | Tison |
| 4,509,223 | A | 4/1985 | Sipple et al. |
| 5,379,542 | A | 1/1995 | Guzman |

FOREIGN PATENT DOCUMENTS

WO WO03/104740 12/2003

OTHER PUBLICATIONS

AIM web page, NcTar AR-15/M16 Combo Tool; Jun. 23, 2008.
Owner's Manual for AR-15 Combo Tool, undated.
Brownells web page, AR-15/M16 Bolt Carrier Carbon Scraper, Jun. 23, 2008.
ADCO Firearms web page, Schuster MFG Carbon Scraper for AR15 Bolt Carrier, Jun. 23, 2008.
AR15.com web page, Bolt Carrier Carbon Scraper, Jun. 23, 2008.
Brownells web page, AR-115/M16 Carrier Carbon Scraper, Jun. 23, 2008.

*Primary Examiner* — Michael Carone
*Assistant Examiner* — Reginald Tillman, Jr.
(74) *Attorney, Agent, or Firm* — Ryan Krumholz & Manion, S.C.

(57) ABSTRACT

A firearm cleaning tool and method of use is disclosed in which multiple firearm components may be cleaned using a single tool. The tool includes cutting or scraping edges to ream residue, such as carbon deposits through a scraping action. The proximal end includes a scraping head with a scraping edge, and the distal end includes pivotable scraper arm and longitudinally extending insertion pin. A method of use is also contemplated.

2 Claims, 3 Drawing Sheets

FIREARM CLEANING TOOL AND METHOD OF USING

RELATED APPLICATIONS

This application is a divisional of co-pending patent application Ser. No. 12/655,939 filed 11 Jan. 2010, which claims the benefit of Provisional Patent Application Ser. No. 61/204,885, filed 12 Jan. 2008.

BACKGROUND OF THE INVENTION

Certain firearms, such as the M4, M16, SR-25, AR-10 and AR-15 weapons are fired using gas operation. The act of firing the weapon subjects certain operating mechanisms to the build up of residue due to exposure to the operating gases of the weapon. As a result, carbon residue accumulates on and around the operating mechanisms, such as the bolt and bolt carrier. Over time, the residue becomes detrimental to operational firing of the weapon. Therefore, it is important to keep operating mechanisms which are prone to residue build up clean, and to periodically remove the residue therefrom.

One of the most residue prone areas of a firearm includes the bolt and bolt carrier. However, the contours of the bolt and bolt carrier create unique difficulties in proper and complete cleaning of the relevant surfaces. Further, once the carbon residue is adhered to a surface it is difficult to remove. In view of these problems, certain tools have been improvised and developed to aid the user in cleaning a firearm, particularly the bolt and bolt carrier.

Known cleaning tools include brushes, dental tools, screwdrivers, and solvents. Use of these types of tools is ineffective at best, and sometimes damaging to the weapon. Other known tools used to remove carbon residue from the bolt and bolt carrier include those sold by NCStar, Brownells, ADCO Firearms, and AR15.com, for example. While these tools may improve the manner of carbon removal from the bolt carrier, none of them adequately addresses removal of carbon from both the bolt tail and the bolt carrier in a single tool.

SUMMARY OF THE INVENTION

The present invention is directed to a firearm maintenance tool for use in cleaning bolts and bolt carriers of certain weapons such as the AR-15, M4, M16, SR-25, or AR-10, and method of using same. A tool according to the present invention is a compact device including cutting or scraping edges to ream residue, such as carbon deposits through a scraping action, and is adapted to clean both a bolt carrier and a bolt, especially the bolt tail in a single tool. The tool preferably includes a proximal end having a scraping head provided with a scraping edge. The scraping head is preferably dimensioned to fit into the bore of a selected bolt carrier to be cleaned and is adapted to ream carbon deposits through an axial rotational scraping action. The tool further includes a distal end having pivotable scraper arm and longitudinally extending insertion pin. The pin is adapted to be inserted into the bore of the bolt tail to be cleaned, while the scraper arm is rotatable for positioning adjacent a bolt tail surface. A method of use is also contemplated.

It is an object of the present invention to provide a new and improved firearm cleaning tool which may be easily manufactured and marketed.

It is a further object of the present invention to provide a new and improved firearm cleaning tool which is of durable and reliable construction.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
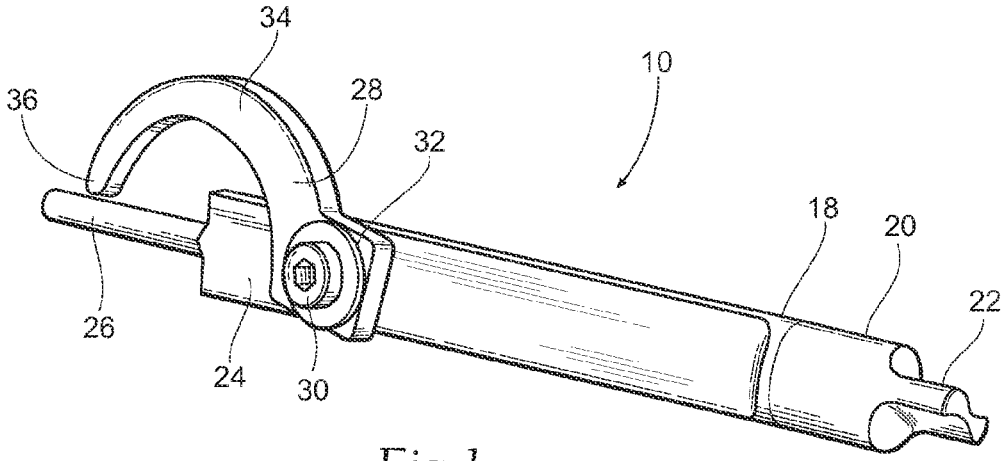
FIG. 1 is a perspective view of a tool according to the present invention and used for cleaning bolts and bolt carriers of weapons.
Figure 2:
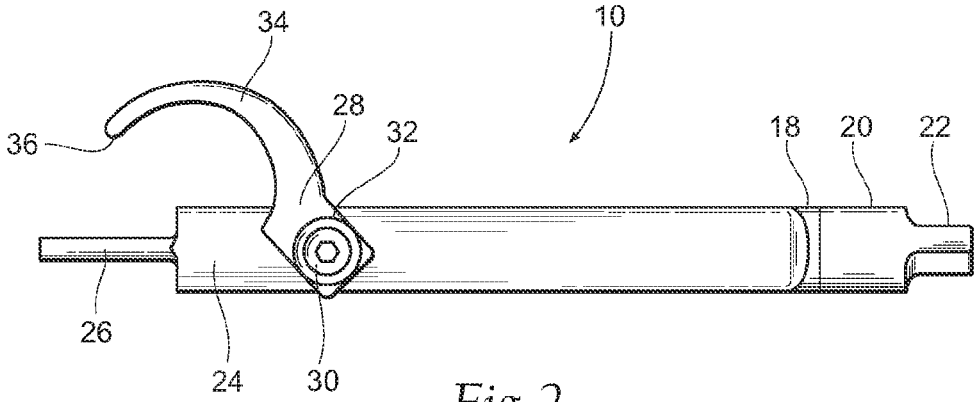
FIG. 2 is a side elevation view of the tool shown in FIG. 1.
Figure 4:
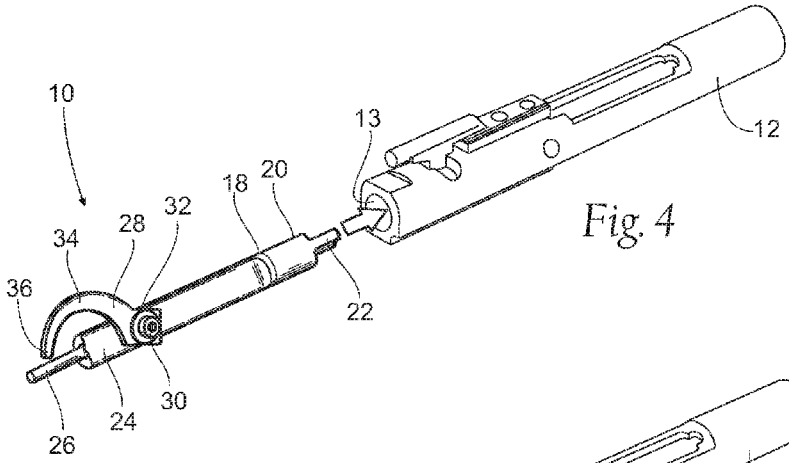
FIG. 4 is a view of a tool according to the present invention with proximal end being inserted into a bolt carrier bore to be cleaned.
Figure 5:
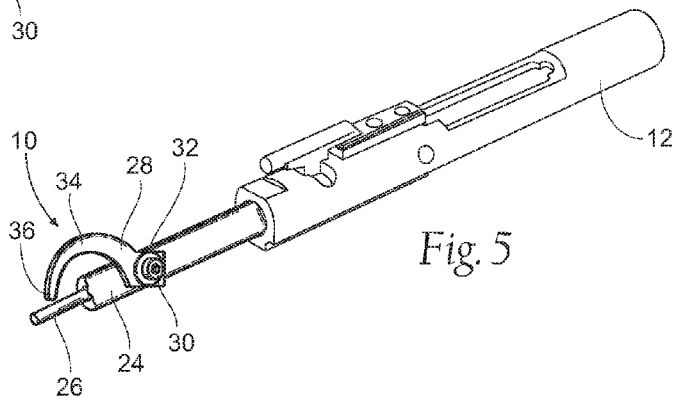
FIG. 5 is a view of a tool according to the present invention with proximal end inserted in a bolt carrier bore to be cleaned.
Figure 6:
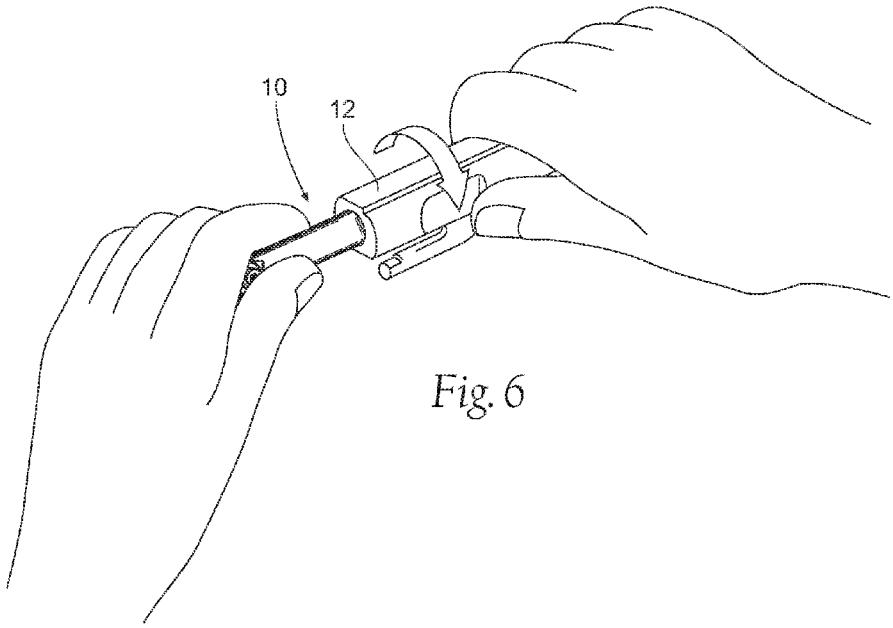
FIG. 6 is a view of a tool according to the present invention with proximal end inserted in a bolt carrier bore to be cleaned, and showing axial movement of the tool.
Figure 7:
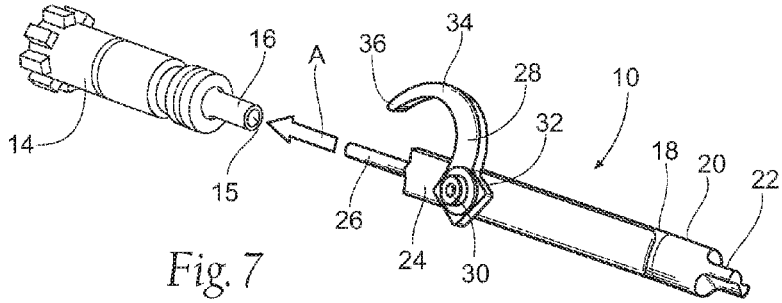
FIG. 7 is a view of a tool according to the present invention and showing the distal end thereof being inserted into a bore of a bolt to be cleaned.
Figure 8:
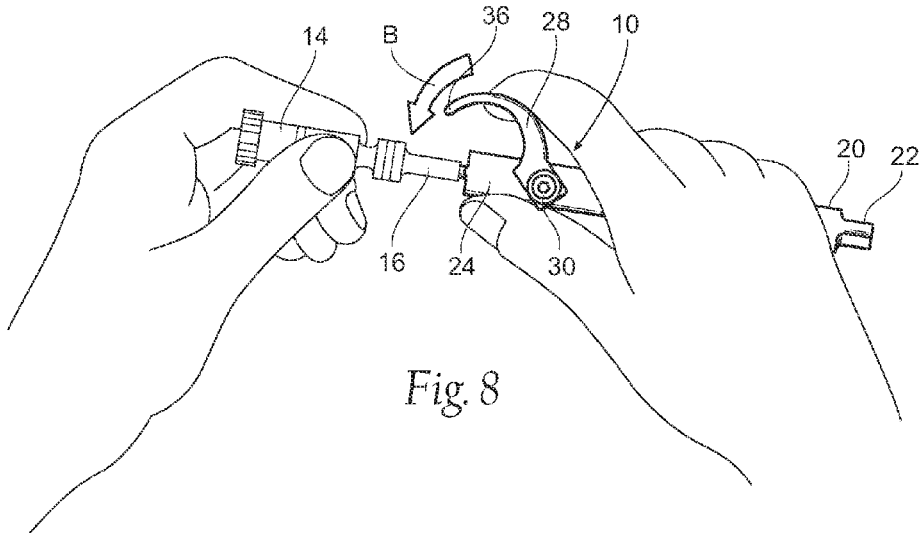
FIG. 8 is a view of a tool according to the present invention, with the distal end thereof inserted into a bore of a bolt tail and pivotal scraper arm moving into contact with the bolt tail.
Figure 9:
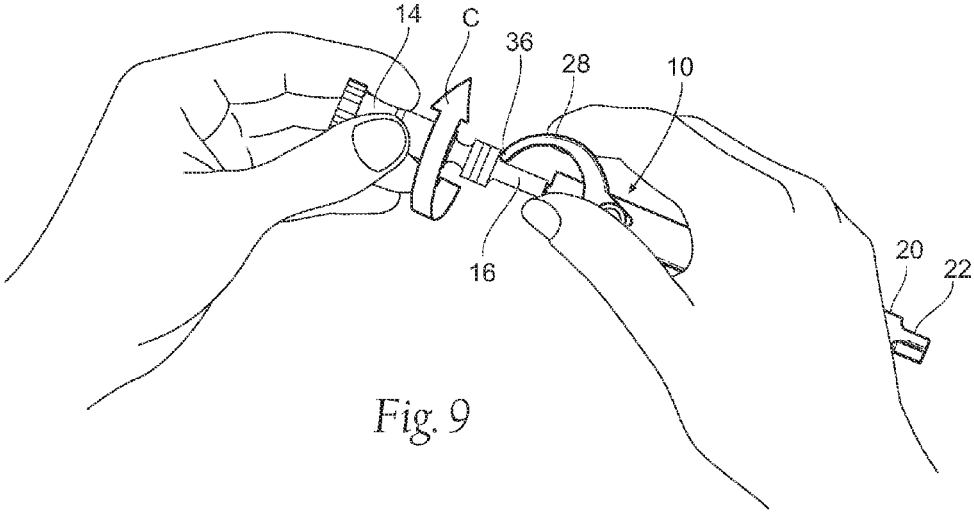
FIG. 9 is a view of a tool according to the present invention, with the distal end thereof inserted into a bolt tail, pivotal scraper arm in contact with the bolt tail and showing axial movement of the tool.

As seen in FIG. 1, the present invention provides a firearm maintenance tool 10. The tool 10 is particularly adapted for use to clean both a bolt carrier 12 (seen in FIGS. 4-6) and a bolt 14, especially the bolt tail 16 (as seen in FIGS. 7-9), of a firearm such as large caliber AR-10, SR-25, MK-11, or M-110, (not shown in these views) by way of non-limiting example. The tool 10 of the present invention preferably includes a proximal end 18 having a scraper head 20, wherein the scraper head 20 is preferably provided with a scraping edge 22. As may be seen particularly in FIGS. 4-6, the scraper head 20 is preferably dimensioned to fit into the bore 13 of a selected bolt carrier 12 to be cleaned and is adapted to ream residue (not shown) by scraping action.

As may be further seen, a tool 10 according to the present invention further includes a distal end 24. The distal end 24 is preferably provided with a longitudinally extending insertion pin member 26. The pin member 26 is adapted for insertion into an end of a bolt 14 to be cleaned. As seen particularly in the views of FIGS. 7-9, the pin 26 is adapted to be inserted into the bore 15 of a bolt tail 16 of the bolt 14 to be cleaned. The distal end 24 further preferably includes a pivotable scraper arm 28. As seen in FIGS. 7-9, the scraper arm 28 is pivotally affixed to the distal end 24 by acceptable means, such as the screw 30 shown, although other means may be envisioned. As illustrated, the scraper arm 28 may include a relatively flat anchor portion 32 and an extending arcuate portion 34. As will be described, the distal end 36 of the arcuate portion 34 is adapted for scraping removal of residue from the bolt 14 and bolt tail 16.

Figure 3:
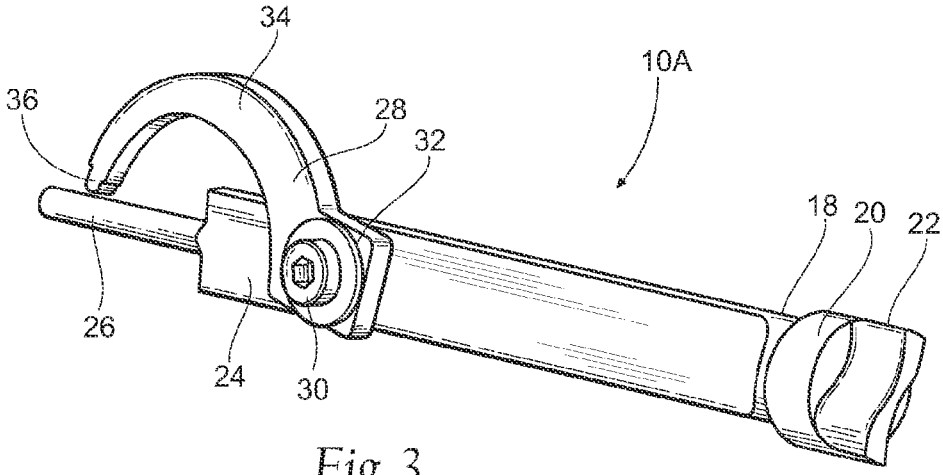
FIG. 3 is a perspective view of an alternative embodiment tool according to the present invention and used for cleaning bolts and bolt carriers of weapons.

Cleaning of the bolt 14 and bolt tail 16 may be seen particularly in the views of FIGS. 7-9. As illustrated, the pin member 26 is inserted into the bore 15 of the tail 16 of the bolt 14 in the direction of arrow A. The scraper arm 28 is rotated in the direction of arrow B to a position in which the distal end 36 of arcuate portion 34 is in contact with the tail 16 or other portion of the bolt 14 to be cleaned. As seen in FIG. 9, cleaning of the bolt tail 16 is accomplished as the bolt 14 and tool 10 are axially rotated relative each other in the direction of arrow C while the end 36 of arcuate portion 34 is in frictional contact with the bolt tail 16 to be cleaned. It is to be understood that the exact dimension and size of the tool 10 may be varied to accommodate cleaning weapons of different caliber, as for example the smaller caliber AR-15 or M-16, by way of non-limiting example. For example, FIG. 3 illustrates an alternative embodiment of a tool 10A according to the present invention. As seen, the tool 10A may be formed having various dimensions to thereby allow use with other firearms (not shown).

A method of cleaning a bolt and bolt carrier of a firearm according to the present invention may include the steps of:

providing a bolt 14 and a bolt carrier 12 to be cleaned;

providing a cleaning tool 10, the cleaning tool 10 including a proximal end 18 and a distal end 24, the proximal end 18 being of a predetermined size capable of being inserted into a bore 13 of the bolt carrier 12 to be cleaned;

providing the proximal end 18 with a scraper head 20, the scraper head 20 including at least one radially extending scraping edge 22;

inserting the proximal end 18 into a selected bolt carrier bore 13 to be cleaned, such that the scraping edge 22 is in contact with an inner wall of the bolt carrier bore 13;

axially rotating the tool 10 and the bolt carrier 12 relative to one another to thereby move the scraping edge 22 relative to the bore 13 to be cleaned;

providing the distal end 24 with a longitudinally extending pin portion 26 and a radially extending pivotal arm member 28, the arm member 28 including an arcuate member 34 having a distal end 36;

inserting the pin portion 26 into the bore 15 of a selected bolt 14 to be cleaned; rotating the arm member 28 until the distal end 36 contacts an outer portion of the bolt 14;

axially rotating the tool 10 and bolt 14 relative to one another such that the arm member distal end 36 removes residue from the bolt 14.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A method of cleaning a firearm including the steps of:

providing a weapon to be cleaned, the weapon including a bolt and a bolt carrier, each respectively having a bore;

providing an elongated weapon cleaning tool having a scraper head at one end thereof and an insertion pin and pivotable scraper arm at the opposite end of said tool;

providing the scraper head with at least one scraping edge;

inserting the scraper head into the bolt carrier bore;

rotating the scraper head and the bore relative to one another;

inserting the insertion pin into the bolt bore;

pivoting the scraper arm to a position at which a distal end of said arm is in contact with the bolt; and rotating the bolt and tool relative to one another.

2. The method of claim 1 wherein said scraper arm has an arcuate shape.

* * * * *

UNITED STATES PATENT AND TRADEMARK OFFICE

CERTIFICATE OF CORRECTION

PATENT NO. : 8,327,571 B2
APPLICATION NO. : 13/474882
DATED : December 11, 2012
INVENTOR(S) : Jaquish et al.

It is certified that error appears in the above-identified patent and that said Letters Patent is hereby corrected as shown below:

Title Page, Item (75) Inventors

Delete "Erik F Bauer, Walde, WI (US)" and substitute – Erik F Bauer, Waldo, WI (US)

Signed and Sealed this
First Day of July, 2014

Michelle K. Lee

Michelle K. Lee
*Deputy Director of the United States Patent and Trademark Office*